US010945578B2

(12) United States Patent
Jung et al.

(10) Patent No.: US 10,945,578 B2
(45) Date of Patent: Mar. 16, 2021

(54) ROBOT CLEANER AND CONTROL METHOD THEREOF

(71) Applicant: SAMSUNG ELECTRONICS CO., LTD., Suwon-si (KR)

(72) Inventors: Jae Young Jung, Suwon-si (KR); Byoung In Lee, Suwon-si (KR); Sang Hwa Choi, Seoul (KR); Dong Won Kim, Hwaseong-si (KR); Sang Sik Yoon, Gimpo-si (KR); Sahng Jin Lee, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 965 days.

(21) Appl. No.: 14/305,565

(22) Filed: Jun. 16, 2014

(65) Prior Publication Data

US 2014/0366292 A1 Dec. 18, 2014

(30) Foreign Application Priority Data

Jun. 17, 2013 (KR) ..... 10-2013-0069015

(51) Int. Cl.
*A47L 11/40* (2006.01)
*A47L 11/282* (2006.01)

(52) U.S. Cl.
CPC ..... *A47L 11/4083* (2013.01); *A47L 11/282* (2013.01); *A47L 11/4008* (2013.01);
(Continued)

(58) Field of Classification Search
CPC .. A47L 11/00; A47L 11/4069; A47L 11/4063; A47L 11/4041; A47L 11/408;
(Continued)

(56) References Cited

U.S. PATENT DOCUMENTS 5,959,423 A 9/1999 Nakanishi et al.
9,402,524 B2 * 8/2016 Yoon ..... A47L 11/33
(Continued)

FOREIGN PATENT DOCUMENTS

DE 10201770 A1 7/2003
EP 0173392 A2 3/1986
(Continued)

OTHER PUBLICATIONS

European Intention to Grant dated Dec. 16, 2015 in corresponding European Patent Application No. 14170541.8.
(Continued)

*Primary Examiner* — Brian D Keller
*Assistant Examiner* — Thomas Raymond Rodgers
(74) *Attorney, Agent, or Firm* — Staas & Halsey LLP

(57) ABSTRACT

A robot cleaner and a control method thereof may judge whether or not water is received in the robot cleaner performing wet cleaning. The robot cleaner includes a main body, moving units, a cleaning unit mounted on the main body and contacting a floor surface to perform cleaning, a water supply unit supplying water to the cleaning unit, and a sensing unit provided on at least a portion of the water supply unit to sense whether or not there is water within the
(Continued)

water supply unit. The sensing unit includes a housing, a transmission part radiating electromagnetic waves, a reception part receiving the electromagnetic waves radiated by the transmission part, and a stepped part provided on at least a portion of the housing along a moving path of the electromagnetic waves radiated by the transmission part and received by the reception part.

11 Claims, 19 Drawing Sheets

(52) U.S. Cl.
CPC ..... *A47L 11/4011* (2013.01); *A47L 11/4041* (2013.01); *A47L 2201/06* (2013.01); *Y10S 901/01* (2013.01); *Y10S 901/46* (2013.01); *Y10T 137/7722* (2015.04)

(58) Field of Classification Search
CPC .. A47L 11/4083; A47L 11/4011; A47L 11/28; A47L 11/282; A47L 2201/00; A47L 11/4008; A47L 2201/06; Y10T 137/772
USPC ..... 15/98, 49.1, 50.1, 103.5, 52.1, 319, 346, 15/340.1; 700/245, 258
See application file for complete search history.

(56) References Cited

U.S. PATENT DOCUMENTS

| | | | | |
|---|---|---|---|---|
| 2005/0245413 | A1* | 11/2005 | Baltes | A47L 15/0049 510/224 |
| 2006/0190146 | A1* | 8/2006 | Morse | A47L 5/14 701/23 |
| 2013/0198993 | A1* | 8/2013 | Jonsson | A47L 9/2815 15/339 |

FOREIGN PATENT DOCUMENTS

| | | | |
|---|---|---|---|
| EP | 0173392 | A3 | 5/1987 |
| EP | 1719442 | A2 | 11/2006 |
| EP | 1719442 | A3 | 5/2009 |
| EP | 2591713 | A2 | 5/2013 |
| EP | 2591713 | A3 | 7/2013 |
| KR | 1997-0007198 | | 2/1997 |
| KR | 1997-0049194 | | 7/1997 |
| WO | 01/08544 | A1 | 2/2001 |

OTHER PUBLICATIONS

Extended European Search Report dated Nov. 10, 2014 in corresponding European Patent Application No. 14170541.8.
Korean Office Action dated Nov. 29, 2019 in Korean Patent Application No. 10-2013-0069015.

* cited by examiner

ROBOT CLEANER AND CONTROL METHOD THEREOF

CROSS-REFERENCE TO RELATED APPLICATIONS

This application claims the benefit of Korean Patent Application No. 10-2013-0069015, filed on Jun. 17, 2013 in the Korean Intellectual Property Office, the disclosure of which is incorporated herein by reference.

BACKGROUND

1. Field

One or more embodiments relate to a robot cleaner and a control method thereof which may judge whether or not water may be received in the robot cleaner performing wet cleaning.

2. Description of the Related Art

In general, a robot cleaner is an apparatus which sucks foreign substances, such as dust, from a floor, while autonomously traveling about a cleaning area to be cleaned without operation of a user, and thus cleans the cleaning area.

The robot cleaner repeatedly performs cleaning operation using a cleaning unit while traveling about the cleaning area. Here, the robot cleaner senses an obstacle or a wall located within the cleaning area through various sensors and performs cleaning while controlling path movement and cleaning operation based on a sensing result.

A general robot cleaner performs cleaning of a floor surface through a dry cleaning method in which dust is sucked from the floor surface.

If cleaning is performed through such a dry cleaning method, foreign substances adhered to the floor surface or foreign substances having a designated size or more are not sucked from the floor surface and, after cleaning operation has been finished, foreign substances may remain on the floor surface.

Therefore, not only a robot cleaner executing dry cleaning which sucks dust from the floor surface, but also a robot cleaner executing wet cleaning which is provided with a pad mounted on the lower surface of a main body so as to wash a floor surface with wash has been developed.

However, if cleaning is performed using a wet cleaning type robot cleaner, water needs to be manually supplied to a pad while directly confirming the amount of moisture in the pad prior to cleaning or during cleaning.

In order to improve such inconvenience, a water level sensor measuring air pressure or electric conductivity changed according to the water level of a water supply unit is used to measure the water level of the water supply unit in which water is received. However, the water level sensor contacts water and may thus cause water leakage and, if a controller contacts the water, the controller may malfunction.

SUMMARY

The foregoing described problems may be overcome and/or other aspects may be achieved by one or more embodiments of a robot cleaner and a control method thereof which may sense the amount of water received in a water supply unit.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

In accordance with one or more embodiments, a robot cleaner may include a main body, moving units moving the main body, a cleaning unit mounted on the main body and contacting a floor surface to perform cleaning, a water supply unit supplying water to the cleaning unit, and a sensing unit provided on at least a portion of the water supply unit to sense whether or not there is water within the water supply unit, wherein the sensing unit may include a housing, a transmission part provided on at least a portion of the sensing unit and radiating electromagnetic waves, a reception part provided on at least a portion of the sensing unit and receiving the electromagnetic waves radiated by the transmission part, and a stepped part provided on at least a portion of the housing along a moving path of the electromagnetic waves radiated by the transmission part and received by the reception part.

At least a portion of the stepped part may be inclined.

A reflective plate to reflect the electromagnetic waves irradiated by the transmission part may be located on one side surface of the sensing unit.

The reception part and the transmission part may be located on one surface opposite the reflective plate.

The reception part and the transmission part may be provided opposite each other.

The transmission part and the reception part may be received within a protrusion part protruding above the cleaning unit.

The sensing unit may further include a holder surrounding the transmission part and the reception part so as to prevent an error due to sensing of electromagnetic waves.

The water supply unit may include a receiver part receiving water and a water supply pump supplying water from the receiver part to the cleaning unit.

The sensing unit may be located in at least a portion of the receiver part.

A controller provided in the sensing unit may judge whether or not water is received in the receiver part by measuring data received by the reception part.

The controller provided in the sensing unit may judge whether or not water is received in the receiver part by measuring change of the amount of current of the water supply pump.

In accordance with one or more embodiments, a robot cleaner may include a main body, moving units moving the main body, a cleaning unit mounted on the main body and contacting a floor surface to perform cleaning, a water supply unit supplying water to the cleaning unit, and a controller judging whether or not water is received in the water supply unit by sensing electrical change within the water supply unit.

The water supply unit may include a receiver part receiving water and a water supply pump supplying water from the receiver part to the cleaning unit.

The controller may judge whether or not water is received in the receiver part by measuring the amount of current supplied to the water supply pump according to operation of the water supply pump.

The robot cleaner may further include a sensing unit located on at least a portion of the receiver part and provided with a sensor unit to judge whether or not water is received in the water supply unit.

The sensor unit may include a transmission part radiating electromagnetic waves and a reception part receiving the radiated electromagnetic waves.

The sensing unit may include a stepped part provided on at least a portion of the housing along a moving path of the electromagnetic waves radiated by the transmission part and received by the reception part.

A reflective plate to reflect the electromagnetic waves radiated by the transmission part may be located on one side surface of the sensing unit, and the reception part and the transmission part may be located on one surface opposite the reflective plate.

The reception part and the transmission part may be provided opposite each other.

The controller may judge whether or not water is received in the receiver part based on data of the sensor unit.

In accordance with one or more embodiments, a control method of a robot cleaner which has a main body, a cleaning unit rotatably mounted on the main body and cleaning a floor surface through a wet cleaning method, a water supply unit supplying water to the cleaning unit, and a sensing unit provided to judge whether or not there is water within the water supply unit, may include judging whether or not the water supply unit is mounted on the cleaning unit, calculating the received amount of electromagnetic waves by causing the sensing unit to transmit electromagnetic waves and to receive the transmitted electromagnetic waves, if the water supply unit is mounted on the cleaning unit, judging whether or not water is received in the water supply unit by calculating the received amount of electromagnetic waves, and displaying whether or not water is received in the water supply unit through a display unit.

The control method may further include displaying a notification representing insufficiency of water in the water supply unit through the display unit, if the received amount of electromagnetic waves exceeds a first reference value.

The control method may further include displaying a notification representing insufficiency of water in the water supply unit through the display unit by judging whether or not a time taken for the robot cleaner to travel from input of a cleaning command to the robot cleaner by a user corresponds to a second reference value, if the received amount of electromagnetic waves exceeds a first reference value.

The control method may further include displaying a notification representing insufficiency of water in the water supply unit through the display unit, if a time during which the robot cleaner performs cleaning exceeds a third reference value.

Whether or not the water supply unit is mounted on the cleaning unit may be judged by recognizing whether or not data generated from at least one of the water supply unit and the cleaning unit is greater than 0.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
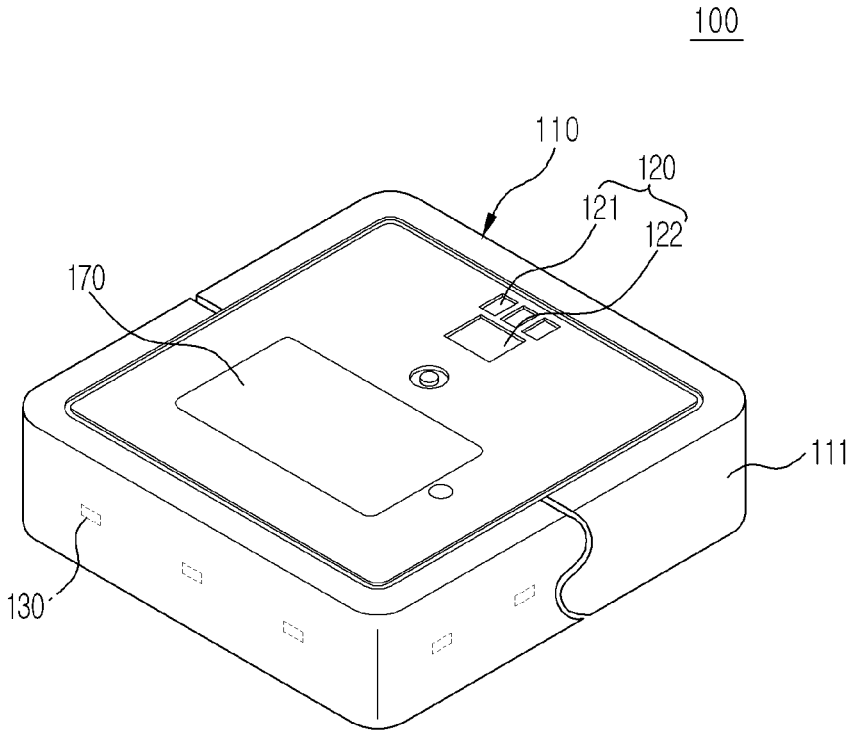
FIG. 1 is a perspective plan view of a robot cleaner in accordance with one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

Figure 2:
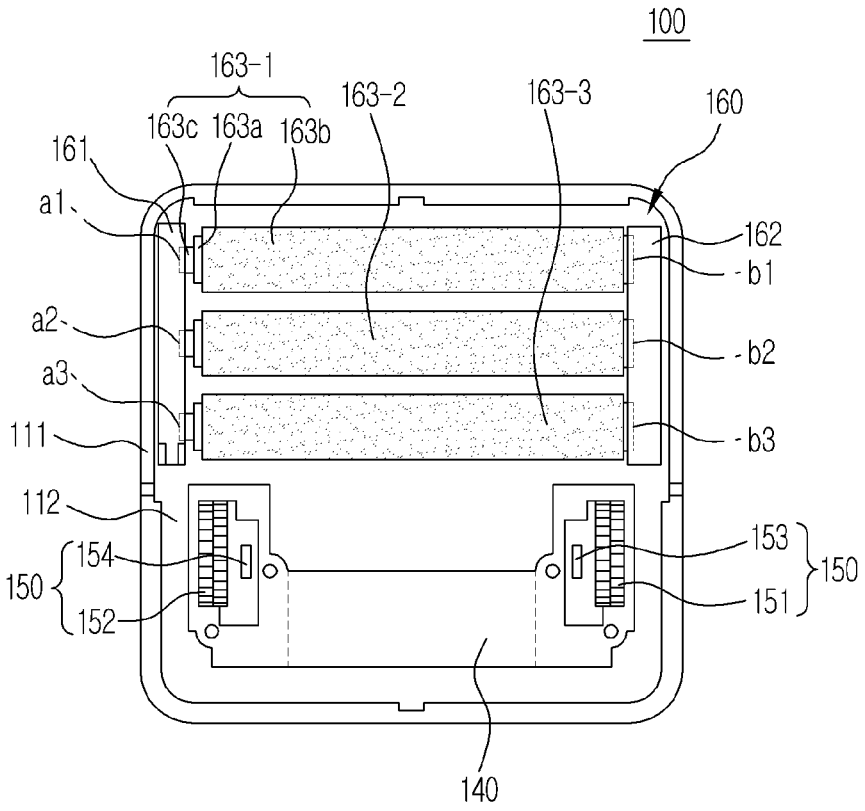
FIG. 2 is a bottom view of a robot cleaner in accordance with one or more embodiments.

FIG. 1 is a perspective plan view of a robot cleaner in accordance with one or more embodiments and FIG. 2 is a bottom view of a robot cleaner in accordance with one or more embodiments.

As shown in FIG. 1, a robot cleaner 100 may include a main body 110 forming the external appearance of the robot cleaner 100, a user interface 120 mounted on the upper surface of the main body 110, to receive operation information and reservation information and displaying the operation information, and obstacle detectors 130 detecting obstacle information within a cleaning area.

The user interface 120 may include an input unit 121 receiving cleaning reservation information and operation information, and a display unit 122 displaying the cleaning reservation information, a charged state, water level information of a water supply unit, an operation mode, etc. Here, the operation mode may be, for example, a cleaning mode, a standby mode, or a docking mode.

The obstacle detector 130 may be a distance sensor which measures not only whether or not there is an obstacle but also a distance between the robot cleaner 100 and an obstacle. The obstacle detectors 130 may be mounted on the front surface and the left and right surfaces of the main body 110, may detect obstacles located in front of and at both sides of the robot cleaner 100, and may output obstacle detection signals.

As shown in FIG. 2, the main body 110 of the robot cleaner 100 may include a bumper 111 mounted on the front surface of the main body 110 to possibly relieve impact during collision with an obstacle, and a frame 112. A power supply unit (not shown), moving units 150, a cleaning unit 160, and a driving unit 190 may be mounted on the frame 112. Another bumper 111 may be additionally mounted on the rear surface of the main body 110.

Further, the main body 110 of the robot cleaner 100 may include insertion holes (not shown) formed at a position corresponding to the cleaning unit 160, at least one water supply hole 114 formed around the insertion hole (not shown) to supply water to the cleaning unit 160, and first spray members 115 and second spray members 116 connected to the plural water supply holes 114 and spraying supplied water to the outside. The insertion holes (not shown), the first spray members 115, and the second spray members 116 may be mounted on the frame 112. Water may be supplied through the water supply holes 114, be sprayed through the first spray member 115 via a first channel 174*a*, and be sprayed through the second spray member 116 via a second channel 174*b*. For this purpose, the first channel 174*a* and the second channel 17*b* may be inserted into the water supply holes 114.

The first spray member 115 and the second spray member 116 are members to supply water to a pad member 163. A detailed description thereof will be given later.

The robot cleaner 100 may include a power supply unit (not shown) supplying driving power to respective components, the moving units 150 installed on the lower surface of the rear portion of the main body 110 and moving the main body 110, the cleaning unit 160 provided on the lower surface of the front portion of the main body 110 and cleaning foreign substances, such as dust on a floor surface, through a wet cleaning method, and a water supply unit 170 supplying water to the cleaning unit 160. The front and rear portions of the main body 110 are determined based on the traveling direction of the main body 110 during cleaning.

The robot cleaner 100 further may include the driving unit 190 driving the moving units 150, the cleaning unit 160, and the water supply unit 170 using power supplied from the power supply unit (not shown).

The power supply unit (not shown) may include a battery electrically connected to the respective components 120, 130, 140, 150, 160, and 170 mounted on the main body 110 and supplying driving power to the components 120, 130, 140, 150, 160, and 170.

Here, the battery may be a secondary battery which may be rechargeable. The battery may be electrically connected to a charging station (not shown) through two charging terminals (not shown), and may perform charging using power supplied from the charging station (not shown).

The moving units 150 may be installed at the left and right edges of the rear region of the main body 110 so as to be rotatable. The moving units 150 may include a pair of wheels 151 and 152 to move the main body 110 forward and backward and to rotate the main body 110 and wheel motors 153 and 154 applying driving power to the respective wheels 151 and 152. The wheels 151 and 152 may be disposed symmetrically.

The cleaning unit 160 may be provided on the lower surface of the front portion of the main body 110 and may clean dust on a floor surface under the main body 110 through the wet cleaning method. A detailed description thereof will be given later.

Figure 3A:
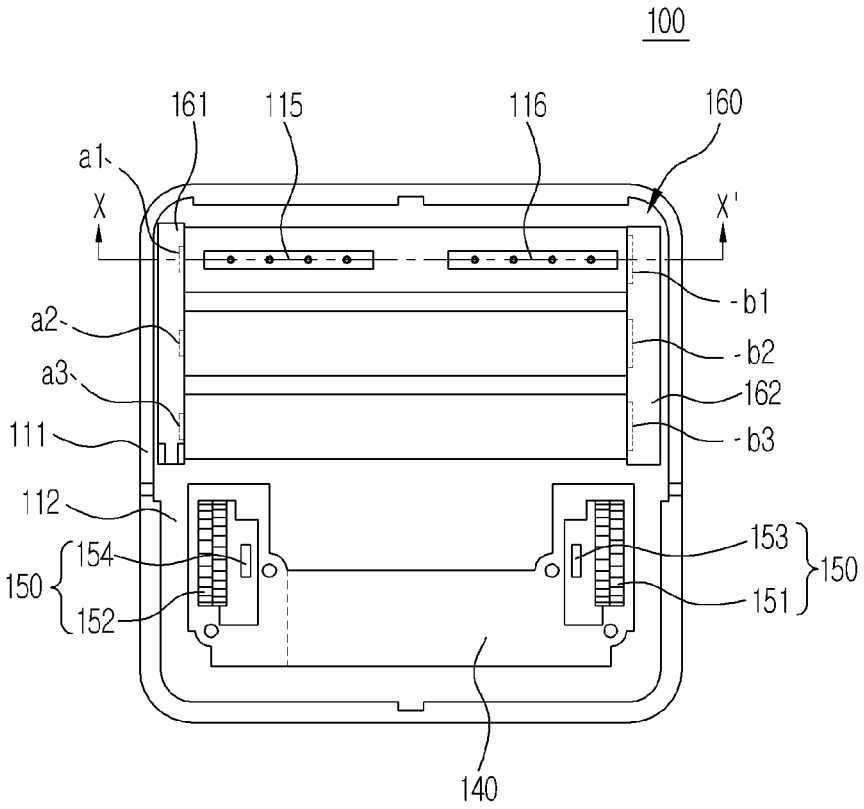
FIG. 3A is a bottom view of a robot cleaner in accordance with one or more embodiments in a state in which a cleaning unit is separated from a main body.
Figure 3B:
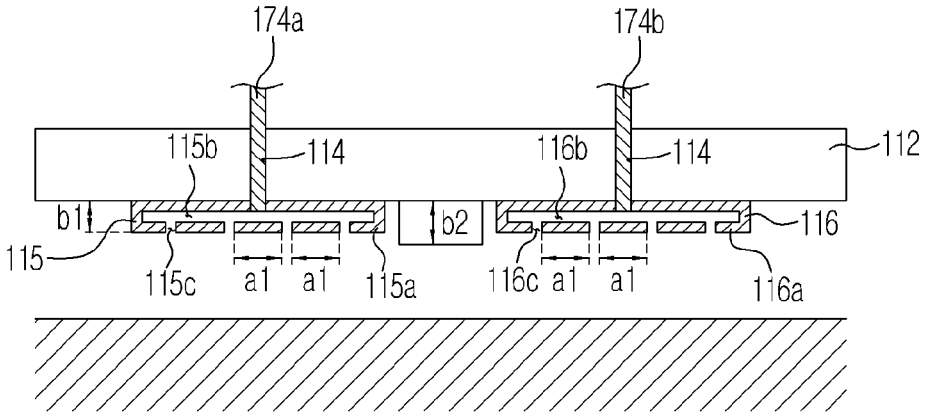
FIG. 3B is a cross-sectional view of the main body of a robot cleaner according to one or more embodiments, such as the robot cleaner shown in FIG. 3A, taken along line X-X'.

FIG. 3A is a bottom view of a robot cleaner in accordance with one or more embodiments in a state in which a cleaning unit is separated from a main body, and FIG. 3B is a cross-sectional view of the main body of a robot cleaner according to one or more embodiments, such as the robot cleaner shown in FIG. 3A, taken along line X-X'.

As shown in FIG. 3A, the first and second spray members 115 and 116 may be disposed on the lower portion of the frame 112. The first and second spray members 115 and 116 may be located so as to communicate with the water supply holes 114. The first and second spray members 115 and 116 may be formed so as to correspond to the position of the pad member 163 performing cleaning through the wet cleaning method. That is, the first and second spray members 115 may be formed on the pad member 163.

As exemplarily shown in FIG. 3B, the first spray member 115 may include a body 115*a* combined with the frame 112, a main channel 115*b* formed in the body 115*a*, and a plurality of spray holes 115*c* formed on the body 115*a*. The main channel 115*b* may receive water supplied from the first channel 174*a* through the water supply hole 114, and the spray holes 115*c* may be connected to the main channel 115*b* and may discharge water in the main channel 115*b* to the outside. The plural spray holes 115*c* may be formed, for example, at the same interval a1.

The second spray member 116 may include a body 116*a* combined with the frame 112, a main channel 116*b* formed in the body 116*a*, and a plurality of spray holes 116*c* formed in the body 116*a*. The main channel 116*b* may receive water supplied from the second channel 174*b* through the water supply hole 114, and the spray holes 116*c* may be connected to the main channel 116*b* and may discharge water in the main channel 116*b* to the outside. The plural spray holes 116*c* may be formed, for example, at the same interval a1.

Further, the first spray member 115 and the second spray member 116 may protrude from the frame 112. The water supply holes 114 may be formed on only one side surface of the frame 112. Channels of the water supply unit 170 may be inserted into the water supply holes 114, and the water supply holes 114 may receive water supplied through the channels and spray the water to the outside through the plural spray holes 115*c* and 116*c*.

Figure 4:
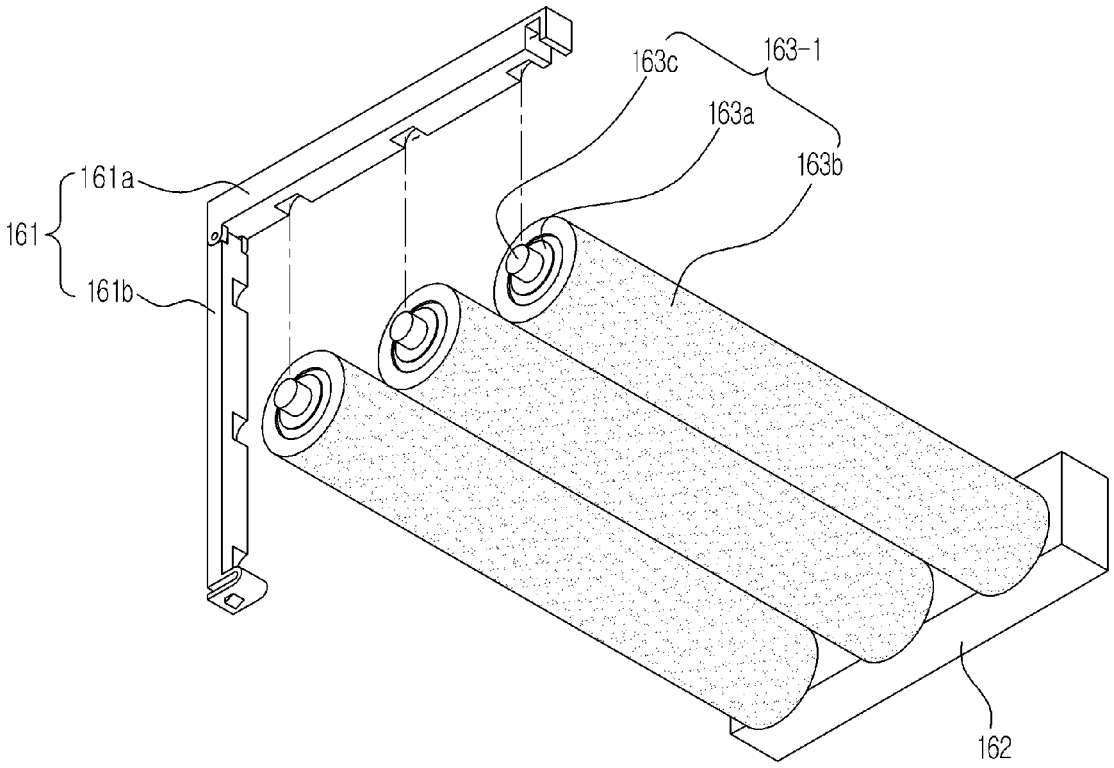
FIG. 4 is an exploded perspective view illustrating the cleaning unit of a robot cleaner in accordance with one or more embodiments.

FIG. 4 is an exploded perspective view illustrating the cleaning unit of a robot cleaner in accordance with one or more embodiments.

As shown in FIG. 4, the cleaning unit 160 may include a first jig member 161 and a second jig member 162 mounted on the left and right surfaces of the front portion of the frame 112 of the main body 110. Further, the cleaning unit 160 may include at least one pad member 163 combined between the first jig member 161 and the second jig member 162 so as to be separable from the first jig member 161 and the second jig member 162. The pad member 163 may be a rotatable drum-type pad member. However, the pad member 163 is not limited thereto and at least one fixed pad member which is not rotatable may be used. Further, if a plurality of pad members 163 is provided, a pad member 163 located at the front portion of the frame 112 based on the traveling direction of the robot cleaner 100 may be a drum-type pad member, and the remaining pad members 163 may be fixed pad members.

One or plural drum-type pad members 163 may be provided. A robot cleaner 100 having three drum-type pad members 163 will be described.

Each of the plural pad members 163 may include a drum 163*a*, a pad 163*b* detachably mounted on the outer surface of the drum 163*a* and contacting a floor surface to clean the floor surface, and protrusions 163*c* formed at both ends of the drum 163*a*. The protrusions 163*c* may protrude outward from both ends of the drum 163*a* and may be inserted into a first hanging hole of the first jig member 161 and a second hanging hole of the second jig member 162.

The pad 163*b* may be separated from the drum 163*a* and thus, may be replaced. The pad 163*b* may protrude outward from the main body 110 so as to possibly secure sufficient frictional force with the floor surface. The pad 163*b* may protrude further in a downward direction than the two wheels 151 and 152.

The first jig member 161 may include a fixed member 161*a* fixed to a first side surface of the frame 112, and a separable member 161*b* separably combined with the fixed member 161*a*.

The fixed member 161*a* and the separable member 161*b* respectively may include a plurality of slots and, when the fixed member 161*a* and the separable member 161*b* are combined with each other, the slots of the fixed member 161*a* and the slots of the separable member 161*b* may form a plurality of first hanging holes a1, a2, and a3. That is, the first jig member 161 may include the plurality of first hanging holes a1, a2, and a3, and one end of each of the pad members 163 may be combined with each of the plurality of first hanging holes a1, a2, and a3.

The separable member 161*b* may be used to separate the pad members 163 combined between the first jig member 161 and the second jig member 162 from the main body 110. The separable member 161*b* may be separated from the fixed member 161*a* and thus, may separate the first pad member 163-1, the second pad member 163-2, and the third pad member 163-3 from the main body 110.

The second jig member 162 may be fixed to a second side surface of the frame 112. That is, the second jig member 162 may be mounted so as to be opposite the first jig member 161.

The second jig member 162 may include a plurality of second hanging holes b1, b2, and b3, and gear members 164 may be installed at the plurality of second hanging holes b1, b2, and b3. The other end of each of the plurality of pad members 163 may be combined with each of the plurality of second hanging holes b1, b2, and b3, and the plurality of pad members 163 combined with the plurality of second hanging holes b1, b2, and b3 may be rotated by driving force of the gear members 164.

The plural pad members 163 may be combined between the first jig member 161 and the second jig member 162. The protrusions 163*c* that may be formed at both ends of the pad members 163 may be inserted into the first hanging holes a1, a2, and a3 and the second hanging holes b1, b2, and b3. That is, the first pad member 163-1 may be rotatably combined between the first hanging hole a1 and the second hanging hole b1, the second pad member 163-2 may be rotatably combined between the first hanging hole a2 and the second hanging hole b2, and the third pad member 163-3 may be rotatably combined between the first hanging hole a3 and the second hanging hole b3.

The plural pad members 163 may be continuously arranged backward based on the traveling direction of the main body 110. Thereby, the second pad member 163-2 and the third pad member 163-3 may sequentially repeatedly move to a position to which the first pad member 163-1 has moved. That is, the robot cleaner 100 may repeatedly clean one position using the plurality of pad members 163.

The plurality of pad members 163 may be rotated in the clockwise direction of the counterclockwise direction. The plurality of pad members 163 may be connected to the different gear members 164 and thus, may be rotated at different rotational speeds in different rotating directions.

Figure 5:
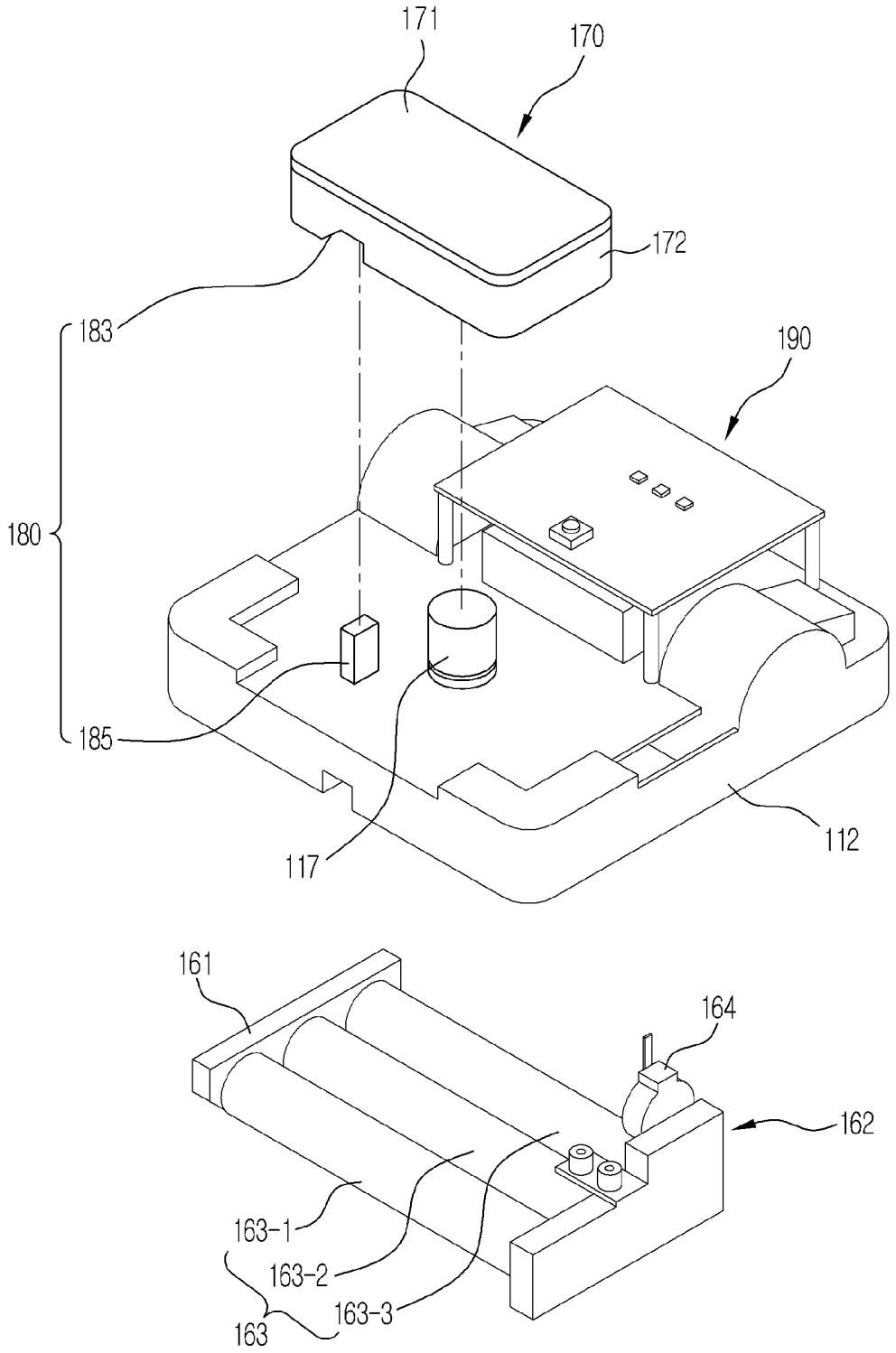
FIG. 5 is an exploded perspective view illustrating the main body and a water supply unit of a robot cleaner in accordance with one or more embodiments.
Figure 6:
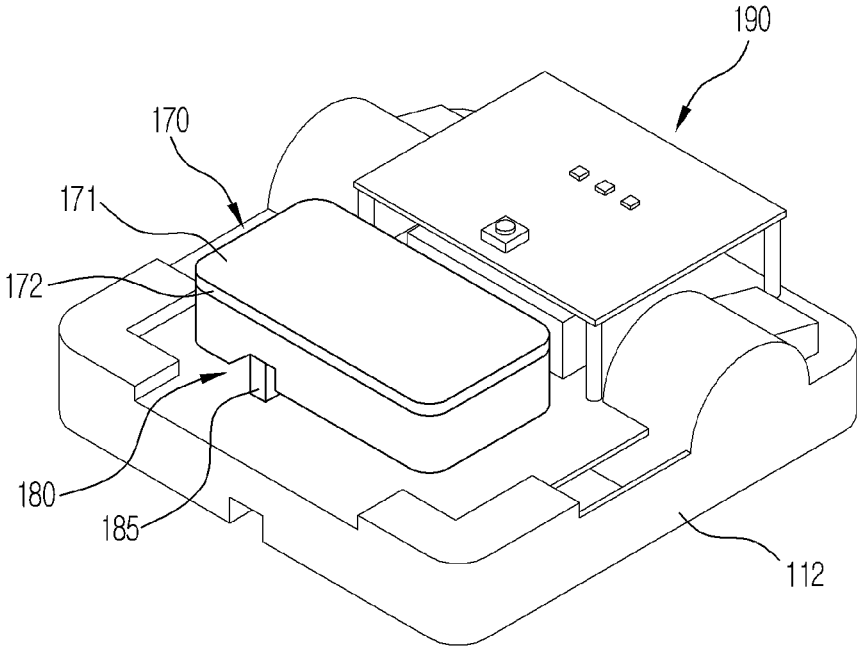
FIG. 6 is a perspective view illustrating a robot cleaner in accordance with one or more embodiments in a state in which the water supply unit is combined with the main body.

FIG. 5 is an exploded perspective view illustrating the main body and a water supply unit of a robot cleaner in accordance with one or more embodiments, and FIG. 6 is a perspective view illustrating a robot cleaner in accordance with one or more embodiments in a state in which the water supply unit is combined with the main body.

As shown in FIGS. 5 and 6, the cleaning unit 160 may be disposed at the lower portion of the frame 112, and the water supply unit 170 may be disposed at the upper portion of the frame 112. The water supply unit 170 may supply water to at least one of the plurality of pad members 163 that may be disposed at the lower portion of the frame 112.

For example, if the water supply unit 170 supplies water to the first pad member 163-1 alone, the pad 163*b* of the first pad member 163-1 located at the front position based on the proceeding direction of the robot cleaner 100 may absorb the supplied water and may become wet, and the pads 163*b* of the second pad member 163-2 and the third pad member 163-3 located at the rear position may be in a dry state. Thereby, the second pad member 163-2 and the third pad member 163-3 may remove moisture from an area cleaned with water by the first pad member 163-1. However, embodiments are not limited thereto.

In accordance with one or more embodiments, the water supply unit 170 may supply water to the second pad member 163-2 located at the middle position.

The water supply unit 170 may include a receiver part 172 to receive water, a water supply pump 117 to supply water from the receiver part 172 to the cleaning unit 160, and a cover 171 covering the upper surface of the receiver part 172.

The receiver part 172 may be disposed on the frame 112, may store water supplied by a user, and may discharge the water to the outside during cleaning. The receiver part 172 may include a supply hole (not shown) through which water may be supplied to the receiver part 172 and a discharge hole 173 (with reference to FIG. 7) through which water may be discharged to the outside during cleaning.

The water supply pump 117 may protrude from the frame 112. One side of the water supply pump 117 may be combined with the discharge hole 173 of the receiver part 172. Thereby, the water supply pump 117 may pump water stored in the receiver part 172 and may supply the pumped water to one or more of the pad members 163. The water supply pump 117 may include an inlet through which water may be supplied to the water supply pump 117 from the receiver part 172 and an outlet through which water may be supplied to the pad member 163.

The water supply unit 170 further may include a sensing unit 180 to sense whether or not water is received within the receiver part 172. The sensing unit 180 may include a sensor unit 187 and 188 radiating and receiving electromagnetic waves, respectively. The sensor unit 187 and 188 may be located within a protrusion part 185 protruding from the frame 112 toward the water supply unit 170.

Figure 7:
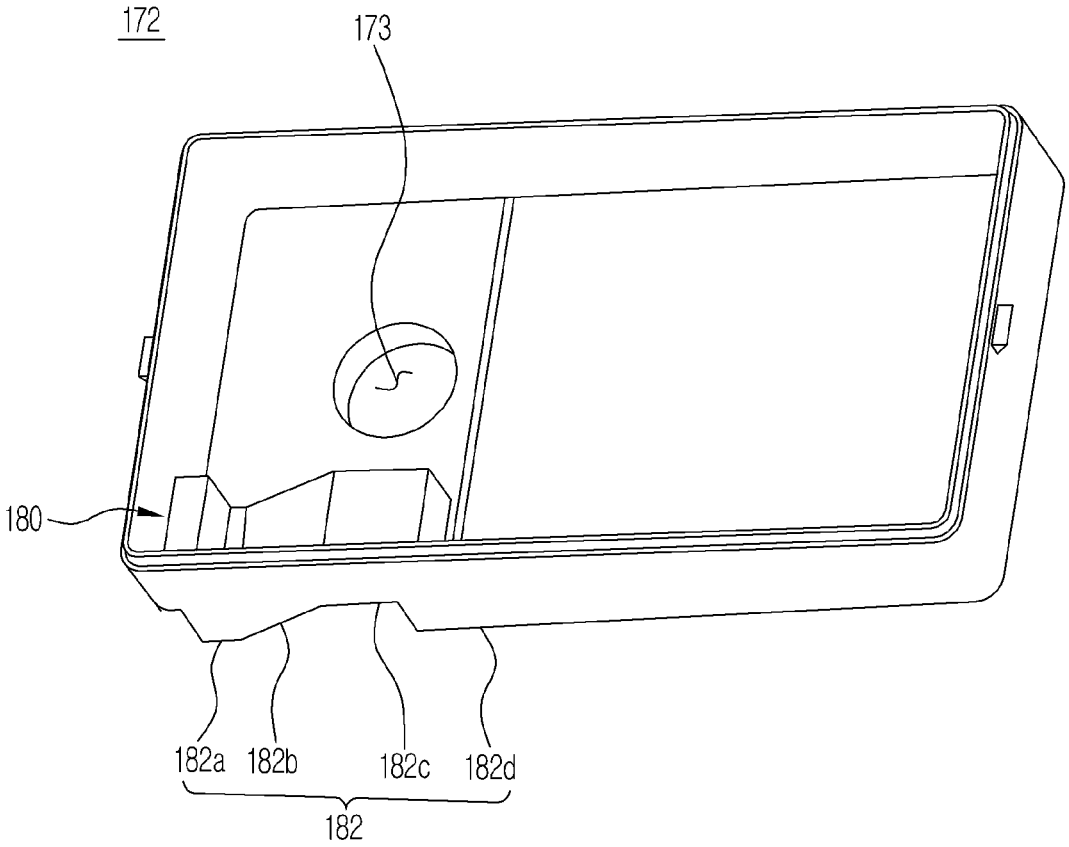
FIG. 7 is a perspective view illustrating a robot cleaner in accordance with one or more embodiments in a state in which a cover of the water supply unit is removed.
Figure 8:
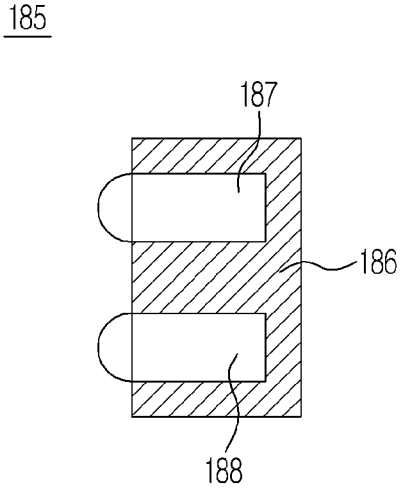
FIG. 8 is a view illustrating a sensor unit of a robot cleaner in accordance with one or more embodiments.
Figure 9:
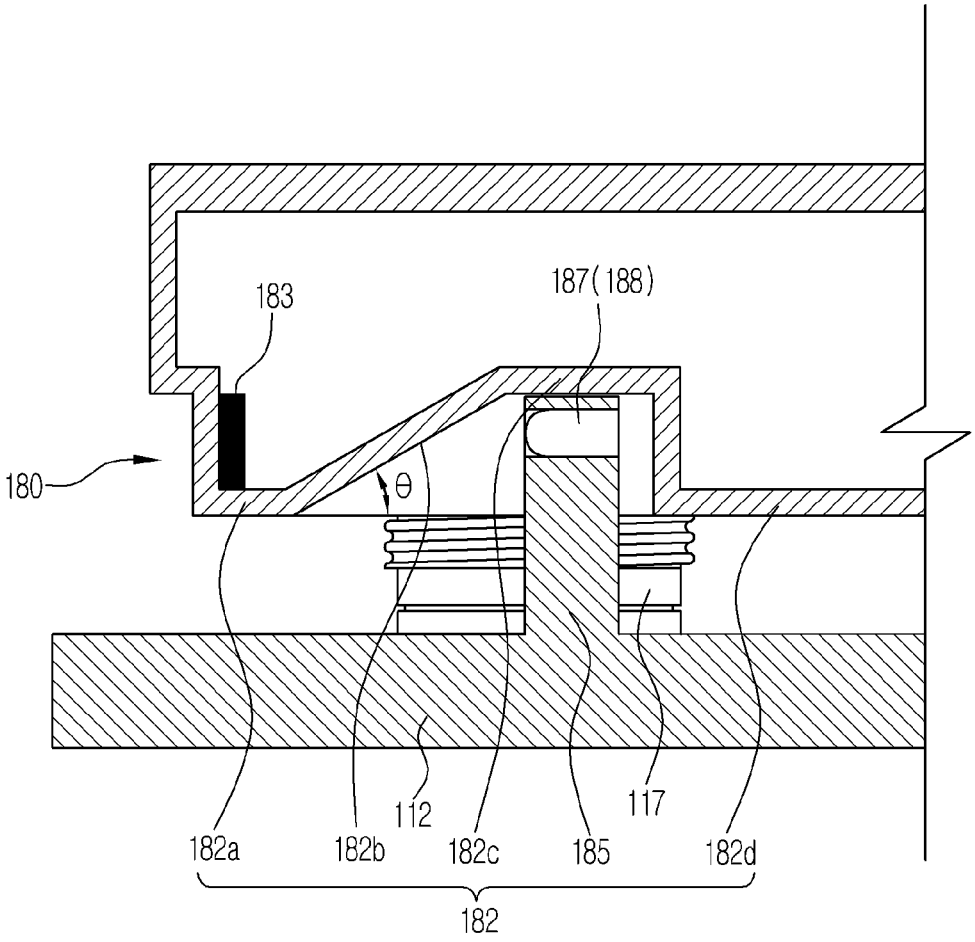
FIG. 9 is a cross-sectional view illustrating a robot cleaner in accordance with one or more embodiments in a state in which the water supply unit is combined with the main body.

FIG. 7 is a perspective view illustrating a robot cleaner in accordance with one or more embodiments in a state in which a cover of the water supply unit is removed, FIG. 8 is a view illustrating a sensor unit of a robot cleaner in accordance with one or more embodiments, and FIG. 9 is a cross-sectional view illustrating a robot cleaner in accordance with one or more embodiments in a state in which the water supply unit is combined with the main body.

As shown in FIGS. 7 to 9, the sensing unit 180 may include a housing 182 and the sensor unit 187 and 188. The sensing unit 180 may be located in at least a portion of the receiver part 172.

At least a portion of the housing 182 may include a stepped part. That is, in accordance with one or more embodiments, the housing 182 may include a first section 182*a*, a second section 182*b*, a third section 182*c*, and a fourth section 182*d*, and the first section 182*a* and the third section 182*c* may be stepped from each other. The second section 182*b* located between the first section 182*a* and the third section 182*c* may be inclined. Further, the third section 182*c* and the fourth section 182*d* may be stepped from each other. The third section 182*c* may be provided to be stepped upward from the first section 182*a*, and the fourth section 182*d* may be provided to be stepped downward from the third section 182*c*. The first section 182*a* and the fourth section 182*d* may have the same height. The second section 182*b* may be provided to be inclined at a designated angle θ or more with the first section 182*a*.

The sensor unit 187 and 188 may be provided at at least a portion of the sensing unit 180 and may include a transmission part 187 radiating electromagnetic waves and a reception part 188 receiving the electromagnetic waves radiated from the transmission part 187. In accordance with one or more embodiments, the sensor unit 187 and 188 may be located within the protrusion part 185 that may protrude from the frame 112 and may radiate and receive electromagnetic waves through slits of the protrusion part 185. Infrared light may be used, for example, as the electromagnetic waves transmitted and received by the sensor unit 187 and 188. Further, light emitting diodes (LEDs) may be used, for example, as the transmission part 187 and the reception part 188. The transmission part 187 and the reception part 188 may be inserted into a holder 186 so as to possibly reduce influence of electromagnetic waves transmitted and received thereby. The holder 186 may be formed of colored plastic so as possibly not to be influenced by electromagnetic waves.

In accordance with one or more embodiments, a reflective plate 183 may be provided at one end of the sensing unit 180. The reflective plate 183 may be provided opposite the sensor unit 187 and 188. Thereby, electromagnetic waves radiated by the transmission part 187 may be reflected by the reflective plate 183 and may be received by the reception part 188. If the reflective plate 183 is located at a position, both the transmission part 187 and the reception part 188 may be located at the same position.

Since the housing 182 of the sensing unit 180 may be provided in a stepped manner, the level of water received in the receiver part 172 may be changed. Thereby, the refractive index of electromagnetic waves transmitted by the transmission part 187 may be changed and thus, the amount of electromagnetic waves received by the reception part 188 may be changed. The level of water in the receiver part 172 may be measured using such a principle. If water exceeding a designated amount is received in the receiver part 172, the amount of electromagnetic waves received by the reception part 188 may be reduced due to water but, if water received in the receiver part 172 does not exceed the designated amount, the amount of electromagnetic waves received by the reception part 188 may be approximately the same as the amount of electromagnetic waves transmitted by the transmission part 187.

Figure 10A:
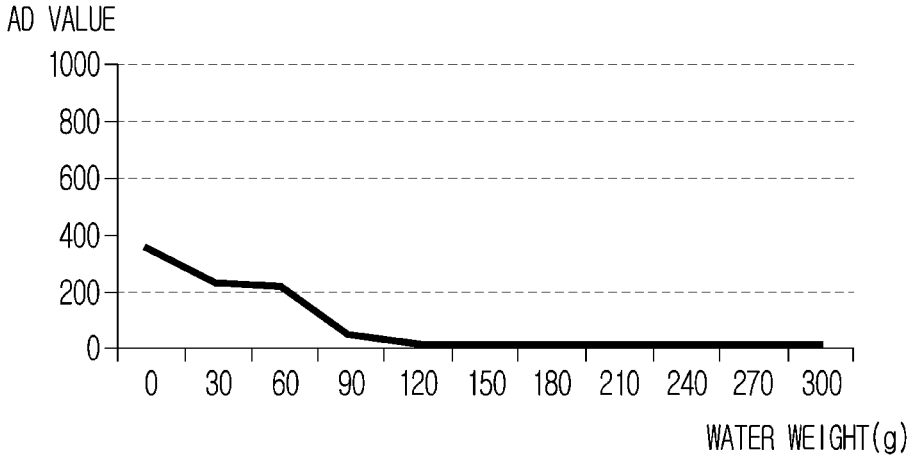
FIGS. 10A to 10C are graphs illustrating AD values according to change in water weight in accordance with one or more embodiments.
Figure 10B:
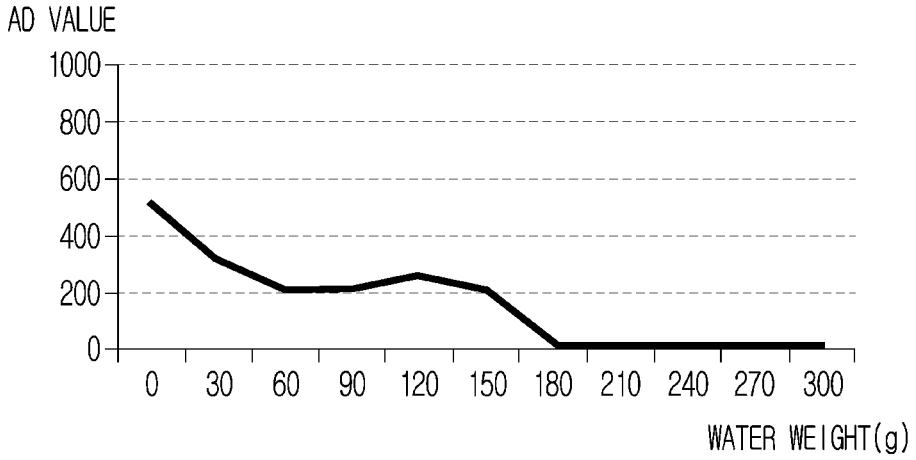
Figure 10C:
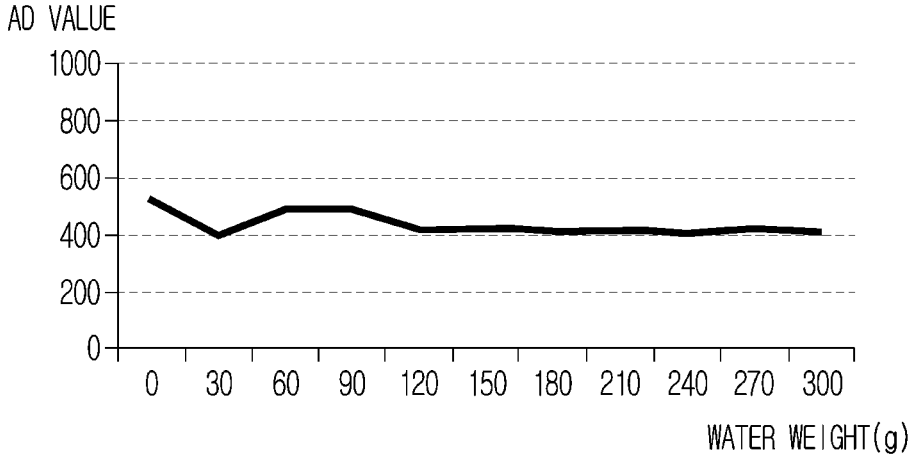

FIGS. 10A to 10C are graphs illustrating AD values according to change in water weight in accordance with one or more embodiments.

FIG. 10A is a graph if the inclination angle θ of the second section 182*b* is 20°, FIG. 10B is a graph if the inclination angle θ of the second section 182*b* is 30°, and FIG. 100 is a graph if the inclination angle θ of the second section 182*b* is 90°.

Since the inclination angle θ of the second section 182*b* means an incidence angle of electromagnetic waves, the amount of electromagnetic waves received by the reception part 188 may vary according to the inclination angle θ of the second section 182*b*. Here, an AD value means a voltage value converted from the amount of electromagnetic waves received by the reception part 188.

It may be understood that, in FIG. 10A, the reception part 188 may not receive light if a water weight is about 90 g, and it may be understood that, in FIG. 10B, the reception part 188 may not receive light if a water weight is about 180 g. In FIG. 100, since the receiver part 172 may pass through the electromagnetic waves even if the water weight is changed, change of electromagnetic waves reaching the reception part 188 according to change in water weight may be small. That is, if the inclination angle θ of the second section 182*b* is less than 90°, the amount of water received in the receiver part 172 may be judged from the amount of electromagnetic waves received by the reception part 188. In more detail, the inclination angle θ of the second section 182*b* may be, for example, approximately 20° to 30°.

Figure 11:
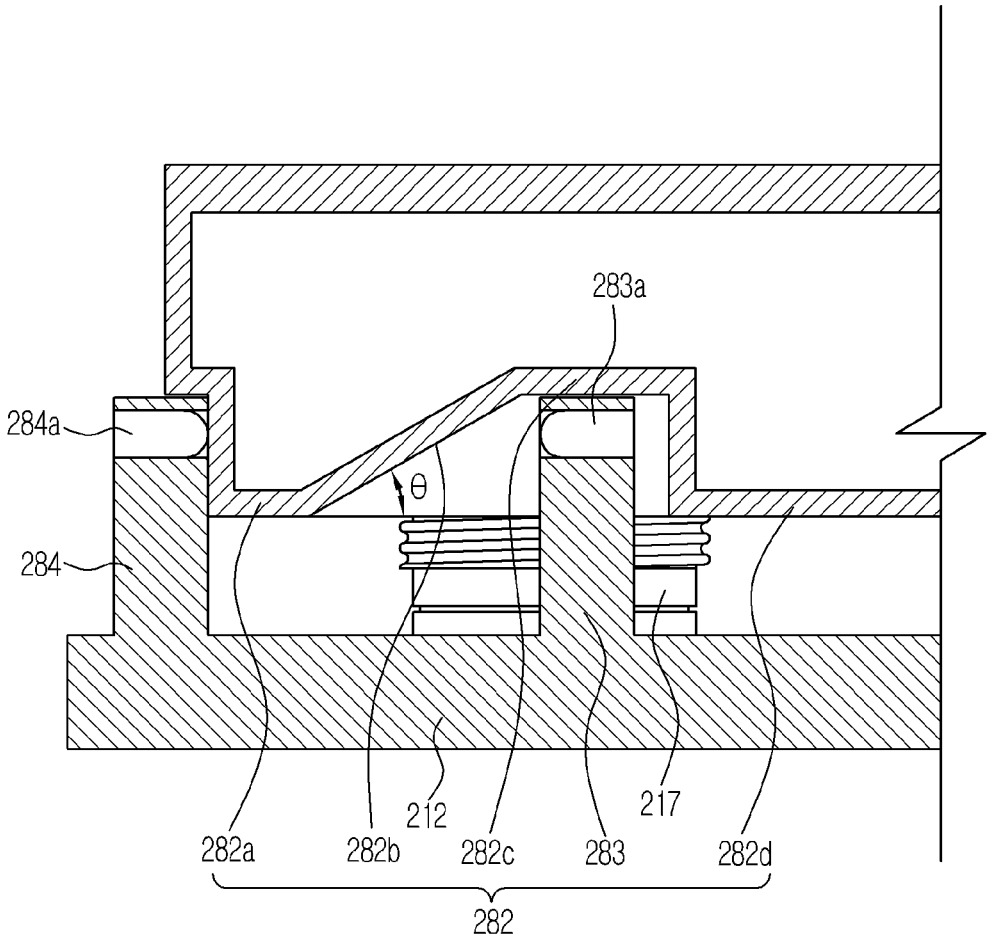
FIG. 11 is a cross-sectional view illustrating a robot cleaner in accordance with one or more embodiments in a state in which a water supply unit is combined with a main body.

FIG. 11 is a cross-sectional view illustrating a robot cleaner in accordance with one or more embodiments in a state in which a water supply unit is combined with a main body.

As shown in FIG. 11, a transmission part 283*a* and a reception part 284*a* may be located so as to be opposite each other. As shown in FIG. 11, the transmission part 283*a* may be located within a first protrusion part 283 protruding from a frame 212 toward a water supply unit 270 and the reception part 284*a* may be located within a second protrusion part 284. However, embodiments are not limited thereto. Further, if the transmission part 283*a* and the reception part 284*a* are located so as to be opposite each other, a reflective plate may be omitted.

In this case, since a housing 282 of a sensing unit 280 may be formed in a stepped manner, whether or not water exceeding a designated amount is received in a receiver part 272 may be judged using change of the refractive index of water received in the receiver part 272.

Figure 12:
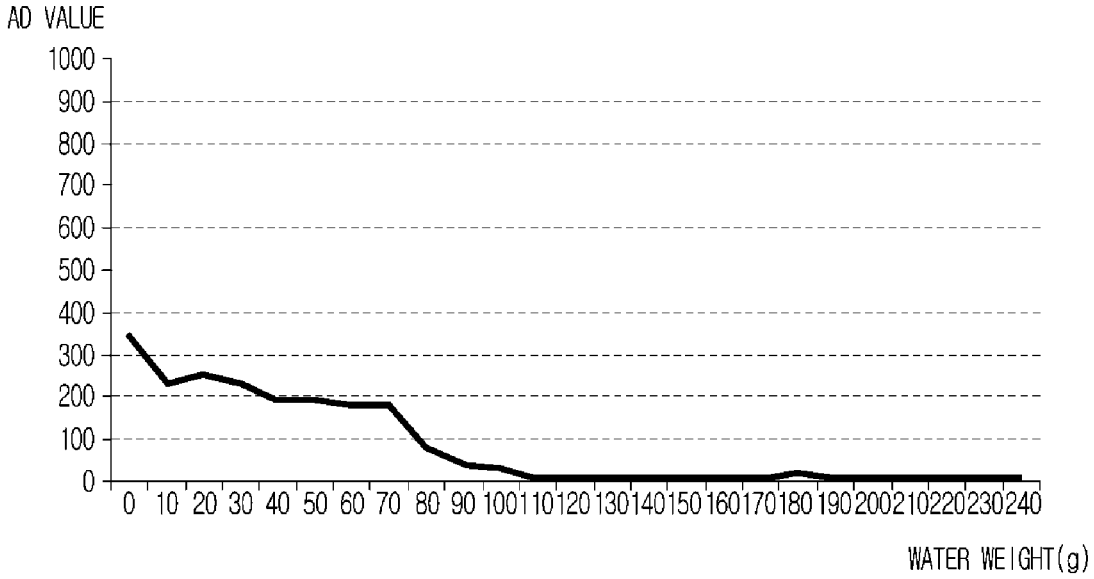
FIG. 12 is a graph illustrating AD values according to change in water weight during traveling of a robot cleaner in accordance with one or more embodiments.

FIG. 12 is a graph illustrating AD values according to change in water weight during traveling of a robot cleaner in accordance with one or more embodiments.

As shown in FIG. 12, it may be understood that the AD value may be changed according to the water weight even while the robot cleaner 100 travels. Further, as shown in FIG. 12, it may be understood that the AD value may be increased if the water weight does not exceed about 70 g to 80 g and thus, whether or not the water weight does not exceed about 70 g (or about 80 g) may be judged through electromagnetic waves received by the reception part.

Figure 13:
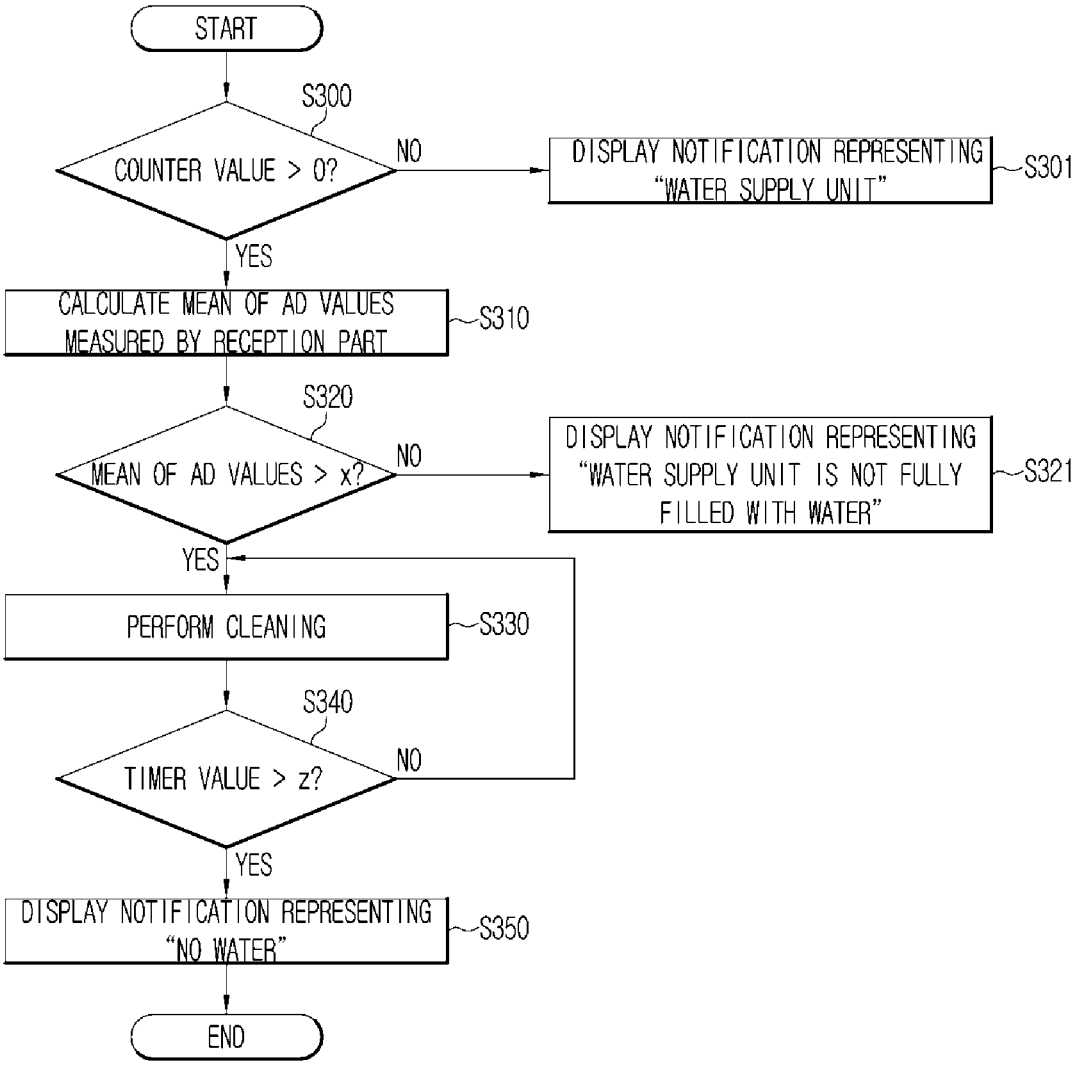
FIG. 13 is a flowchart illustrating a control method of a robot cleaner in accordance with one or more embodiments.

FIG. 13 is a flowchart illustrating a control method of a robot cleaner in accordance with one or more embodiments.

Hereinafter, a control method of a robot cleaner in accordance with one or more embodiments will be described with reference to FIG. 13.

When a user inputs a traveling command to the robot cleaner, if the water supply unit is mounted on the main body, a counter value may increase. Whether or not the water supply unit is mounted on the main body may be judged based, for example, on whether or not a micro switch located on the main body is switched on due to mounting of the water supply unit. Therefore, when the user inputs the traveling command to the robot cleaner, the controller may judge whether or not the counter value is greater than 0 (Operation S300). If the counter value is greater than 0, it may be judged that the water supply unit is mounted on the main body and next operation may be carried out. On the other hand, if the counter value is not greater than 0, a notification indicating "Water supply unit is not mounted" may be displayed on the display unit (Operation S301).

If the counter value is greater than 0, the mean of AD values measured by the reception part may be calculated (Operation S310). This may serve to judge whether or not water is received in the receiver part of the water supply unit. The reason for calculation of the mean of the AD values is that the AD value may be changed during traveling of the robot cleaner.

Thereafter, the controller may judge whether or not the calculated mean of the AD values is greater than a first reference value x (Operation S320). The first reference value x may be set. In accordance with one or more embodiments, the first reference value x may be set, for example, to about 150. The AD value of 150 may indicate that, if the inclination angle θ of the second section is 20°, a water weight may be approximately 70 g~80 g. That is, the AD value of more than 150 may indicate that the weight of water within the receiver part may be more than approximately 70 g~80 g, and the AD value of less than 150 may indicate that the weight of water within the receiver part may be less than approximately 70 g~80 g. The AD value may be changed according to the inclination angle θ of the second section. Therefore, since the AD value of more than 150 may indicate that the receiver part is filled with water of more than a designated amount, the robot cleaner may perform cleaning (Operation S330). Since the AD value of less than 150 may indicate that water in the receiver part is insufficient, a notification indicating "Water supply unit is not fully filled with water" may be displayed on the display unit (Operation S321).

Thereafter, the controller may judge whether or not a timer value satisfies a third reference value z (Operation S340). The third reference value z means a time when water of a designated weight may become 0 g. In accordance with one or more embodiments, the third reference value z may be set to a time when the beginning water weight of 70 g~80 g may become 0 g. Therefore, the timer value exceeding the third reference value z may indicate that water in the water supply unit may be used up, and the timer value not exceeding the third reference value z may indicate that water remains in the water supply unit. Therefore, if the timer value exceeds the third reference value z, a notification indicating "There is no water in water supply unit" may be displayed on the display unit (Operation S350). If the timer value does not exceed the third reference value z, the robot cleaner may continuously perform cleaning (Operation S330).

Figure 14:
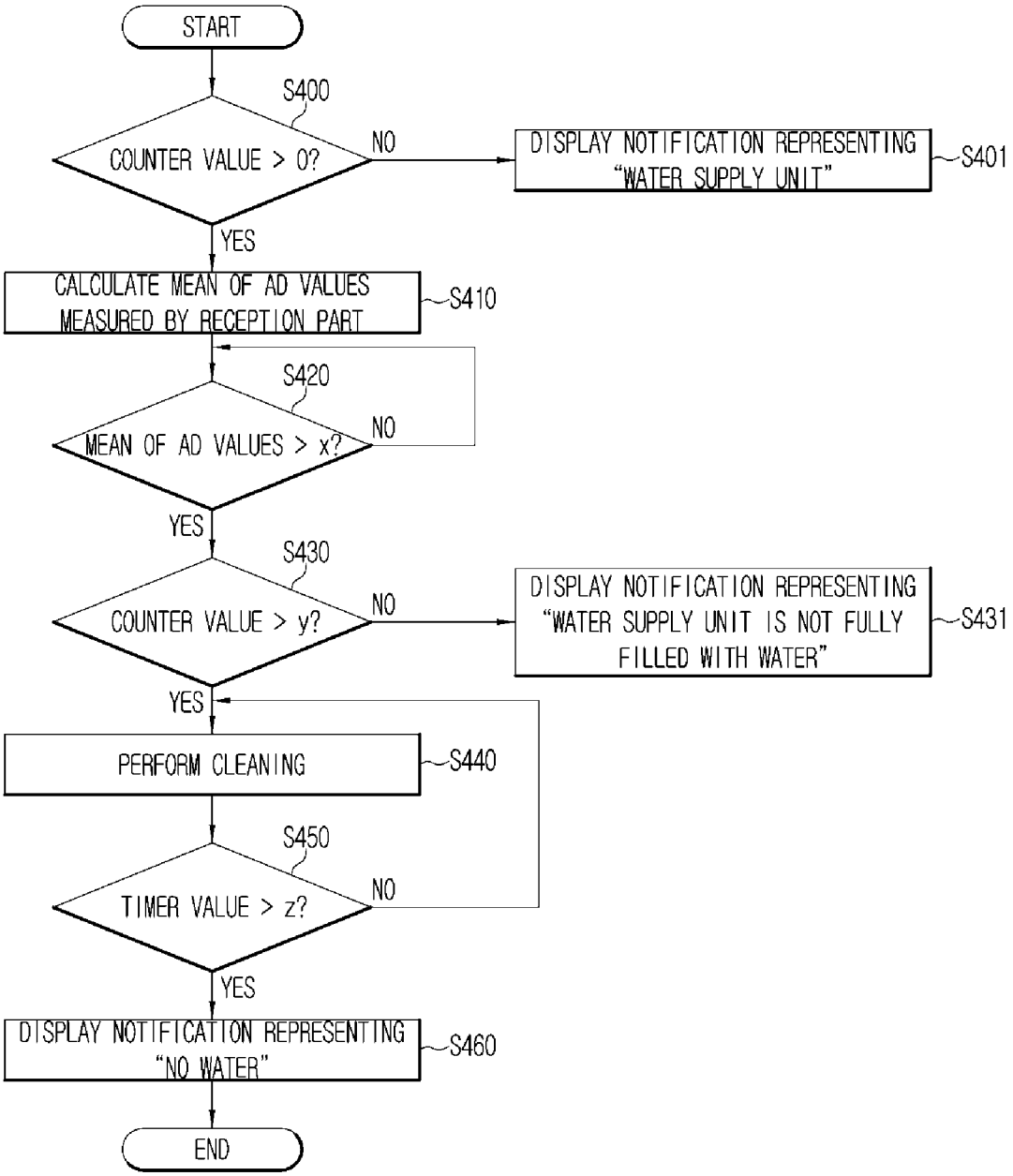
FIG. 14 is a flowchart illustrating a control method of a robot cleaner in accordance with one or more embodiments.

FIG. 14 is a flowchart illustrating a control method of a robot cleaner in accordance with one or more embodiments.

In accordance with one or more embodiments, FIG. 14 is a flowchart illustrating sensing the case that the weight of water in the water supply unit is less than 10 g.

When a user inputs a traveling command to the robot cleaner, if the water supply unit is mounted on the main body, a counter value may increase. Whether or not the water supply unit is mounted on the main body may be judged based on whether or not a micro switch located on the main body is switched on due to mounting of the water supply unit. Therefore, when the user inputs the traveling command to the robot cleaner, the controller may judge whether or not the counter value is greater than 0 (Operation S400). If the counter value is greater than 0, it may be judged that the water supply unit is mounted on the main body and next operation may be carried out. On the other hand, if the counter value is not greater than 0, a notification indicating "Water supply unit is not mounted" may be displayed on the display unit (Operation S401).

If the counter value is greater than 0, the mean of AD values measured by the reception part may be calculated (Operation S410). This may serve to judge whether or not water is received in the receiver part of the water supply unit. The reason for calculation of the mean of the AD values is that the AD value may be changed during traveling of the robot cleaner.

Thereafter, the controller may judge whether or not the calculated mean of the AD values is greater than a first reference value x (Operation S420). In accordance with one or more embodiments, the first reference value x may be set to about 150. The AD value of 150 may indicate that, if the inclination angle θ of the second section is 20°, a water weight is approximately 70 g~80 g. That is, the AD value of more than 150 may indicate that the weight of water within the receiver part may be less than approximately 70 g~80 g, and the AD value of less than 150 may indicate that the weight of water within the receiver part is more than approximately 70 g~80 g. The AD value may be changed according to the inclination angle θ of the second section.

If the AD value exceeds the first reference value x, the controller may judge whether or not the counter value exceeds a second reference value y (Operation S430). The second reference value y may indicate a time taken for the robot cleaner to travel from input of the traveling command by the user. This may serve to confirm whether or not the water supply unit is fully filled with water within a short time. Since the counter value exceeding the second reference value y may indicate that the water supply unit is filled with water, the robot cleaner may perform cleaning. If the counter value does not exceed the second reference value y, a notification indicating "Water supply unit is not fully filled with water" may be displayed on the display unit (Operation S431).

Thereafter, the robot cleaner may perform cleaning (Operation S440).

Thereafter, the controller may judge whether or not a timer value satisfies a third reference value z (Operation S450). The third reference value z may indicate a time when water of a designated weight may become 0 g. In accordance with one or more embodiments, the third reference value z may be set to a time when the beginning water weight of approximately 70 g~80 g may become 0 g. Therefore, the timer value exceeding the third reference value z may indicate that water in the water supply unit is used up, and the timer value not exceeding the third reference value z may indicate that water remains in the water supply unit. Therefore, if the timer value exceeds the third reference value z, a notification indicating "There is no water in water supply unit" may be displayed on the display unit (Operation S460). If the timer value exceeds the third reference value z, the robot cleaner may continuously perform cleaning (Operation S440).

Figure 15:
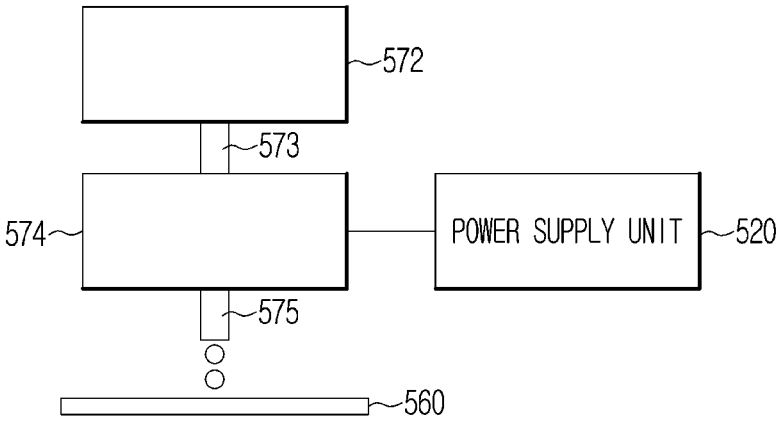
FIG. 15 is a view illustrating a portion of a robot cleaner in accordance with one or more embodiments.

FIG. 15 is a view illustrating a portion of a robot cleaner in accordance with one or more embodiments.

In accordance with one or more embodiments, whether or not water is received in a water supply unit 572 may be judged by measuring change of current supplied to a water supply pump 574 supplying water to a cleaning unit. Water within the water supply unit 572 may move to a pad member 560 through the water supply pump 574. A first channel 573 may be provided between the water supply unit 572 and the water supply pump 574 so that water may move along the first channel 573, and a second channel 575 may be provided between the water supply pump 572 and the pad member 560 so that water may be sprayed to the pad member 560.

The water supply pump 574 may be connected to a power supply unit 520 to supply power to the water supply pump 574. If water is received within the water supply unit 572, the water supply pump 574 may be operated to supply water to the pad member 560. Thereby, current of more than a designated amount may be supplied to the water supply pump 574. However, if water is not received within the water supply unit 572, supply of water to the pad member 560 may not be required and thus, the water supply pump 574 may not be operated. Thereby, current may not be supplied to the water supply pump 574. That is, in accordance with one or more embodiments, whether or not water is received within the water supply unit 572 may be judged by measuring the amount of current supplied to the water supply pump 574.

Figure 16:
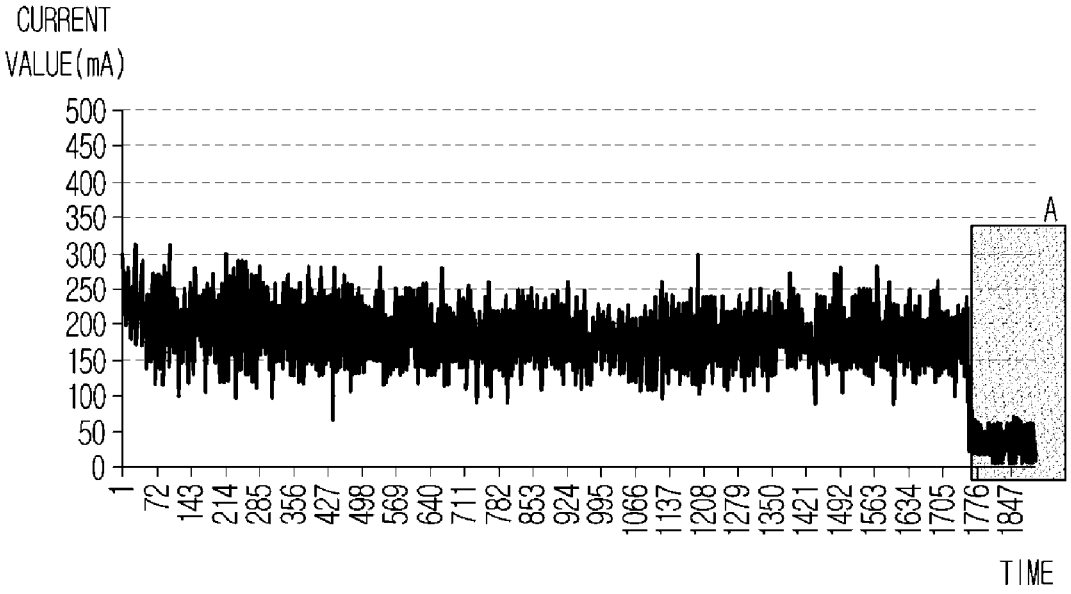
FIG. 16 is a graph illustrating current values according to time in a robot cleaner in accordance with one or more embodiments.

FIG. 16 is a graph illustrating current values according to time in a robot cleaner in accordance with one or more embodiments.

As shown in FIG. 16, it may be understood that current may maintain a designated value and may then be suddenly lowered in a region A after a designated time has elapsed. For example, a current value if there is water within the water supply unit 572 may be about 230 mA, and a current value if there is no water within the water supply unit 572 may be about 50 mA. In such a manner, whether or not water remains within the water supply unit 572 may be checked by measuring the current value of the water supply pump 574 and, in accordance with one or more embodiments, whether or not water remains within the water supply unit 572 may be checked without a separate sensing unit.

As is apparent from the above description, a robot cleaner and a control method thereof in accordance with one or more embodiments may judge whether or not water is received in a water supply unit by changing the structure of the water supply unit, thus reducing a possibility of abnormality regarding judgment as to whether or not there is water in the water supply unit. Further, a robot cleaner and a control method thereof in accordance with one or more embodiments may judge whether or not water is received in a water supply unit by measuring the amount of current used by a water supply pump, thus judging whether or not water is received in the water supply unit through a simple structure.

In one or more embodiments, any apparatus, system, element, or interpretable unit descriptions herein include one or more hardware devices or hardware processing elements. For example, in one or more embodiments, any described apparatus, system, element, retriever, pre or post-processing elements, tracker, detector, encoder, decoder, etc., may further include one or more memories and/or processing elements, and any hardware input/output transmission devices, or represent operating portions/aspects of one or more respective processing elements or devices. Further, the term apparatus should be considered synonymous with elements of a physical system, not limited to a single device or enclosure or all described elements embodied in single respective enclosures in all embodiments, but rather, depending on embodiment, is open to being embodied together or separately in differing enclosures and/or locations through differing hardware elements.

In addition to the above described embodiments, embodiments can also be implemented through computer readable code/instructions in/on a non-transitory medium, e.g., a computer readable medium, to control at least one processing device, such as a processor or computer, to implement any above described embodiment. The medium can correspond to any defined, measurable, and tangible structure permitting the storing and/or transmission of the computer readable code.

The media may also include, e.g., in combination with the computer readable code, data files, data structures, and the like. One or more embodiments of computer-readable media include: magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. Computer readable code may include both machine code, such as produced by a compiler, and files containing higher level code that may be executed by the computer using an interpreter, for example. The media may also be any defined, measurable, and tangible distributed network, so that the computer readable code is stored and executed in a distributed fashion. Still further, as only an example, the processing element could include a processor or a computer processor, and processing elements may be distributed and/or included in a single device.

The computer-readable media may also be embodied in at least one application specific integrated circuit (ASIC) or Field Programmable Gate Array (FPGA), as only examples, which execute (e.g., processes like a processor) program instructions.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A robot cleaner comprising:

a main body;

moving units configured to move the main body;

a cleaning unit mounted on the main body and configured to contact a surface to perform cleaning;

a water supply unit configured to contain water in a housing of the water supply unit and to supply the contained water to the cleaning unit, the housing including an inclined portion extending upward from a horizontal bottom surface of the housing and provided at an interior portion of the housing; and a sensing unit provided on at least a portion of the water supply unit and configured to sense an amount of the water contained within the water supply unit, wherein the sensing unit includes:

a transmission part outside the water supply unit such that the transmission part is separated from water, and configured to radiate electromagnetic waves toward the inclined portion of the housing of the wafer supply unit, and a reception part outside the water supply unit such that the reception part is separated from water, and configured to receive the electromagnetic waves radiated by the transmission part through the inclined portion of the housing of the water supply unit, wherein an inclination angle of the inclined portion of the housing adjacent to the horizontal bottom surface of the housing is less than 90 degrees from the horizontal bottom surface of the housing.

2. The robot cleaner according to claim 1, further comprising:

a reflective plate to reflect the electromagnetic waves radiated by the transmission part, the reflective plate located on one side surface of the sensing unit.

3. The robot cleaner according to claim 2, wherein the reception part and the transmission part are located on one surface of the sensing unit opposite the reflective plate.

4. The robot cleaner according to claim 1, wherein the reception part and the transmission part are provided opposite to each other.

5. The robot cleaner according to claim 1, wherein the transmission part and the reception part are disposed within a protrusion part protruding above the cleaning unit.

6. The robot cleaner according to claim 5, wherein the sensing unit further includes a holder surrounding the transmission part and the reception part so as to prevent an error in sensing of the electromagnetic waves.

7. The robot cleaner according to claim 1, further comprising:

a water supply pump to supply the water from the water supply unit to the cleaning unit, wherein the water supply unit includes a receiver part to receive and store the water.

8. The robot cleaner according to claim 7, wherein the sensing unit is located in the receiver part.

9. The robot cleaner according to claim 8, further comprising:

a controller connected to the sensing unit to determine the amount of the water contained within the water supply unit based on the electromagnetic waves received by the reception part.

10. The robot cleaner according to claim 8, further comprising:

a controller to determine whether or not the water is contained in the receiver part of the water supply unit based on a change of an amount of electric current supplied to the water supply pump while the water supply pump is operated to supply the water from the water supply unit to the cleaning unit.

11. The robot cleaner according to claim 1, wherein a travel path of the electromagnetic waves causes the electromagnetic waves to be received by the reception part while less than a predetermined amount of the water is contained within the water supply unit, and wherein a refractive index of the electromagnetic waves causes the travel path of the electromagnetic waves to not be received by the reception part while more than the predetermined amount of the water is contained within the water supply unit.

* * * * *